US005628464A

United States Patent [19]

Smith et al.

[11] Patent Number: 5,628,464

[45] Date of Patent: May 13, 1997

[54] FLUIDIZED BED JET MILL NOZZLE AND PROCESSES THEREWITH

[75] Inventors: Lewis S. Smith, Fairport; Gerardo Leute, Penfield, both of N.Y.

[73] Assignee: Xerox Corporation, Stamford, Conn.

[21] Appl. No.: 571,664

[22] Filed: Dec. 13, 1995

[51] Int. Cl.[6] ..... B02C 19/06

[52] U.S. Cl. ..... 241/5; 241/39

[58] Field of Search ..... 239/558, 568, 239/553.3; 241/5, 39, 40

[56] References Cited

U.S. PATENT DOCUMENTS

| | | | |
|---|---|---|---|
| 2,272,564 | 2/1942 | Kuever | 241/39 X |
| 2,605,144 | 7/1952 | Nortup | 241/39 X |
| 2,821,346 | 1/1958 | Fisher | 241/39 |
| 4,057,190 | 11/1977 | Kiwior et al. | 239/558 |
| 4,617,742 | 10/1986 | Brummel | 239/568 X |
| 5,099,619 | 3/1992 | Rose | 241/39 X |

*Primary Examiner*—Mark Rosenbaum
*Attorney, Agent, or Firm*—John L. Haack

[57] ABSTRACT

A fluidized bed jet mill for grinding particulate material including a jetting nozzle comprising: a hollow cylindrical body; an integral face plate member attached to the end of the cylindrical body directed towards the center of the jet mill; and an articulated annular slotted aperture in the face plate for communicating a gas stream from the nozzle to the grinding chamber to form a particulate gas stream in the jet mill.

17 Claims, 2 Drawing Sheets

FLUIDIZED BED JET MILL NOZZLE AND PROCESSES THEREWITH

REFERENCE TO COPENDING AND ISSUED PATENTS

Attention is directed to commonly owned and assigned U.S. Pat. No. 5,133,504, issued Jul. 28, 1992, entitled "Throughput Efficiency Enhancement of Fluidized Bed Jet Mill".

Attention is directed to commonly owned and assigned, copending application U.S. Ser. No. 08/409,125 (D/94639) filed Mar. 23, 1995, entitled "Throughput Efficiency Enhancement of Fluidized Bed Jet Mill".

The disclosure of the above mentioned patent application are incorporated herein by reference in their entirety.

BACKGROUND OF THE INVENTION

Fluid energy, or jet, mills are size reduction machines in which particles to be ground, known as feed particles, are accelerated in a stream of gas such as compressed air or steam, and ground in a grinding chamber by their impact against each other or against a stationary surface in the grinding chamber. Different types of fluid energy mills can be categorized by their particular mode of operation. Mills may be distinguished by the location of feed particles with respect to incoming air. In the commercially available Majac jet pulverizer, produced by Majac Inc., particles are mixed with the incoming gas before introduction into the grinding chamber. In the Majac mill, two streams of mixed particles and gas are directed against each other within the grinding chamber to cause fracture of the particles. An alternative to the Majac mill configuration is to accelerate within the grinding chamber particles that are introduced from another source. An example of the latter is disclosed in U.S. Pat. No. 3,565,348 to Dickerson, et al., which shows a mill with an annular grinding chamber into which numerous gas jets inject pressurized air tangentially.

During grinding, particles that have reached the desired size must be extracted while the remaining, coarser particles continue to be ground. Therefore, mills can also be distinguished by the method used to classify the particles. This classification process can be accomplished by the circulation of the gas and particle mixture in the grinding chamber. For example, in "pancake" mills, the gas is introduced around the periphery of a cylindrical grinding chamber, short in height relative to its diameter, inducing a vorticular flow within the chamber. Coarser particles tend to the periphery, where they are ground further, while finer particles migrate to the center of the chamber where they are drawn off into a collector outlet located within, or in proximity to, the grinding chamber. Classification can also be accomplished by a separate classifier. Typically, this classifier is mechanical and features a rotating, vaned, cylindrical rotor. The air flow from the grinding chamber can only force particles below a certain size through the rotor against the centrifugal forces imposed by the rotation of the rotor. The size of the particles passed varies with the speed of the rotor; the faster the speed of the rotor, the smaller the particles. These particles become the mill product. Oversized particles are returned to the grinding chamber, typically by gravity.

Yet another type of fluid energy mill is the fluidized bed jet mill in which a plurality of gas jets are mounted at the periphery of the grinding chamber and directed to a single point on the axis of the chamber. This apparatus fluidizes and circulates a bed of feed material that is continually introduced either from the top or bottom of the chamber. A grinding region is formed within the fluidized bed around the intersection of the gas jet flows; the particles impinge against each other and are fragmented within this region. A mechanical classifier is mounted at the top of the grinding chamber between the top of the fluidized bed and the entrance to the collector outlet.

The primary operating cost of jet mills is for the power used to drive the compressors that supply the pressurized gas. The efficiency with which a mill grinds a specified material to a certain size can be expressed in terms of the throughput of the mill in mass of finished material for a fixed amount of power expended and produced by the expanding gas. One mechanism proposed for enhancing grinding efficiency is the projection of particles against a plurality of fixed, planar surfaces, fracturing the particles upon impact with the surfaces. An example of this approach is disclosed in U.S. Pat. No. 4,059,231 to Neu, in which a plurality of impact bars with rectangular cross sections are disposed in parallel rows within a duct, perpendicular to the direction of flow through the duct. The particles entrained in the air stream passing through the duct are fractured as they strike the impact bars. U.S. Pat. No. 4,089,472 to Siegel et al., discloses an impact target formed of a plurality of planar impact plates of graduated sizes connected in spaced relation with central apertures through which a particle stream can flow to reach successive plates. The impact target is interposed between two opposing fluid particle streams, such as in the grinding chamber of a Majac mill.

Although fluidized jet mills can be used to grind a variety of particles, they are particularly suited to grinding other materials, such as toners, used in electrostatographic reproducing processes. These toner materials can be used to form either two component developers, typically with a coarser powder of coated magnetic carrier material to provide charging and transport for the toner, or single component developers, in which the toner itself has sufficient magnetic and charging properties that carrier particles are not required. The single component toners are composed of, for example, resin and a pigment such as commercially available MAPICO Black or BL 220 magnetite. Compositions for two component developers are disclosed in U.S. Pat. Nos. 4,935,326 and 4,937,166 to Creatura et al.

In the aforementioned U.S. Pat. 5,133,504 to Smith et al., is disclosed a fluidized bed jet mill with a grinding chamber with a peripheral wall, a base, and a central target, mounted within the grinding chamber and centered on the chamber central axis. Multiple sources of high velocity gas are mounted in the peripheral wall of the grinding chamber, are arrayed symmetrically about the central axis, and are oriented to direct high velocity gas along an axis intersecting the central axis of the grinding chamber. Each of the gas sources has a nozzle holder, a nozzle mounted in one end of the holder oriented toward the grinding region, and optionally an annular accelerator tube mounted concentrically about the nozzle holder. The end of the accelerator tube closer to the nozzle is larger in diameter than the nozzle holder and the opposite end of the accelerator tube. The accelerator tube and the nozzle holder define between them an annular opening through which particulate material in the grinding chamber can enter and be entrained with the flow of gas from the nozzle and accelerated within the accelerator tube to be discharged toward the impact target centered on the central axis. These embodiments can be combined for further efficiency enhancement. A problem associated with solid body impact target is that the target may suffer mechanical stress and wear from continuous particle bombardment, particularly in an annular area substantially defined by the circular perimeter created by the particle gas stream projected onto the target. The complexities and concommitant economics associated with maintenance and replacement of the target assemblies can be considerable.

The toners are typically melt compounded into sheets or pellets and processed in a hammer mill to a mean particle size of between about 400 to 800 microns. They are then ground in the fluid energy mill to a mean particle size of between 3 and 30 microns. Such toners have a relatively low density, with a specific gravity of approximately 1.7 for single component and 1.1 for two component toner. They also have a low glass transition temperature, typically less than about 70° C. The toner particles will tend to deform and agglomerate if the temperature of the grinding chamber exceeds the glass transition temperature.

Although the fluidized bed jet mill is satisfactory, it could be enhanced to provide a significant improvement in grinding efficiency. The aforementioned Siegel and Neu disclosures are directed to mills in which the particles are mixed with gas jet flows that are outside the grinding chamber and as such are not suited for use in a fluidized bed mill. The Smith et al., disclosure is directed to a fluidized bed jet mill apparatus for grinding particles and which grinding is achieved by impinging the particle streams against a solid impact target. In the aforementioned copending application U.S. Ser. No. 08/409,125 (D/94639) filed Mar. 23, 1995, there is disclosed an improved apparatus and method of grinding particles in a jet mill that has a grinding chamber with a peripheral wall, a base, a central axis, and a rigid impact target with a hollow interior or internal cavity, and a plurality of openings or apertures for material transport therethrough and grinding contact therewith. Other embodiments include: having at least one plate type impact target with at least one aperture therethrough, the impact target being mounted within the grinding chamber and centered about an axis and which axis is perpendicular to and intersects the central axis of the grinding chamber.

Thus, there is a need for an improved apparatus and method for enhancing the grinding efficiency of a fluidized bed jet mill.

SUMMARY OF THE INVENTION

It is an object of the present invention to overcome deficiencies of prior art devices described above and to provide grinding equipment and grinding processes with improved grinding efficiency and throughput.

It is another object of the present invention, in embodiments, to provide a fluidized bed jet mill that has at least one jetting nozzle, and preferrably a plurality of nozzles, the jetting nozzle comprising: a hollow cylindrical body; an integral or detachable face plate member attached to the end of the cylindrical body directed towards the center of the jet mill chamber; and an articulated annular slotted aperture in the face plate for communicating a gas stream from the nozzle to the chamber and wherein the gas stream contains, or is capable of entraining, particles substantially on the gas stream surface.

In still another object of the present invention is provided, in embodiments, a nozzle having articulated annular slots in the face plate thereof, wherein the slots have an arcuate geometry which produces a high cross sectional area and a maximum surface area or periphery of the gas jet stream egressing therefrom, wherein the resulting high surface gas stream is capable of entraining substantial amounts of particulate material thereon, and wherein the resulting gas particle stream is capable of producing substantially higher and more efficient particulate grinding and particle size reduction, for example, throughput efficiency improvements of from about 5 to about 30 percent, when at least two articulated particle gas streams are placed in operation in partial or direct opposition to one another.

Another object of the present invention provides, in embodiments, a nozzle jet comprising an integral or separable face plate member having an articulated annular slotted aperture therethrough which enables particulate material in the grinder bed to access the interior surface of the gas stream or streams and subsequent particle entrainment without the need for a central feed tube and which feed tubes have been used to accomplish the aforementioned interior gas stream surface particle access.

In yet another object of the present invention, in embodiments, is provided a method of grinding particles comprising introducing unground particles into a grinding chamber of a fluidized bed jet mill; injecting gas from at least two sources of high velocity gas into the grinding chamber through a nozzle comprising a hollow cylindrical body, an integral face plate member attached to the end of the cylindrical body directed towards the center of the jet mill, and an articulated annular slotted aperture in the face plate for communicating a gas stream from the nozzle to the grinding chamber to form a particulate gas stream in the jet mill; forming a fluidized bed of the unground particles within the chamber; entraining and accelerating a portion of the unground particles with the high velocity gas to form a high velocity particle gas stream; fracturing the portion of the entrained particles into smaller particles by projecting the particle gas stream against opposing particle gas streams; separating from the unground particles and the smaller particles a portion of the smaller particles smaller than a selected size; discharging the portion of the smaller particles from the grinding chamber; and continuing to grind the remainder of the smaller particles and the unground particles until the smaller particles smaller than a selected size are obtained thereby, wherein the high velocity gas stream has a high surface area periphery or profile, and wherein the relative throughput grinding efficiency is improved from about 5 percent to about 30 percent compared to, for example, a circular aperture nozzle of equivalent cross sectional area.

In still another object of the present invention is provided, in embodiments, a method for grinding particles of electrostatographic developer materials, for example, single and two component developers and toners.

In another object of the present invention is the provision of high efficiency processes and apparatus for grinding particulate materials and which processes and apparatus substantially simplify the grinder system complexity and the costs associated with construction and operation.

It is an object of the present invention to provide simple and economical processes and apparatus for grinding particulate materials.

Other objects, features, and advantages of the present invention will be apparent to those of ordinary skill in the art from the following detailed description of the invention.

DETAILED DESCRIPTION OF THE INVENTION

Figure 1:
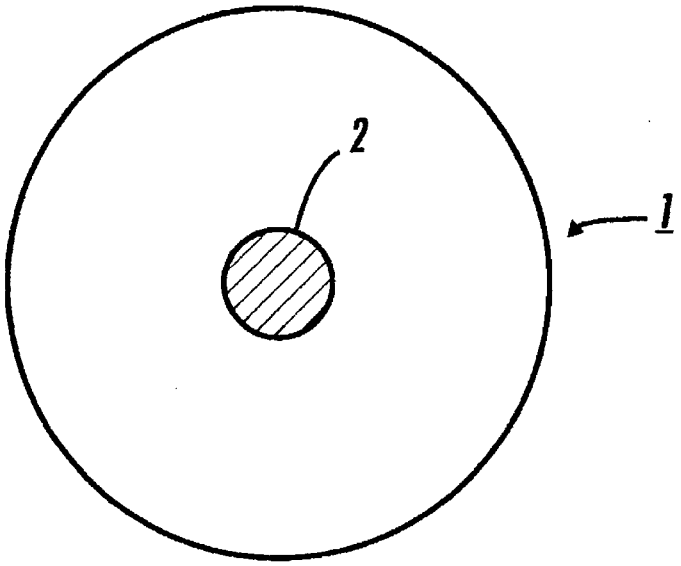
FIG. 1 (PRIOR ART)
FIG. 1 is a schematic representation of a circular nozzle face plate with a circular aperture therein as disclosed in the prior art.

The present invention provides, in embodiments, improvements in the particle jetting efficiency of the prior art fluid bed jet mill by employing an apparatus and method for grinding particles. The apparatus, in embodiments, comprises a fluidized bed jet mill for grinding particulate material comprising: a grinding chamber having a peripheral wall, a base, and a central axis; an optional rigid or hollow bodied impact target, for example, as disclosed in the aforementioned commonly owned U.S. Pat. No. 5,133,504, or in copending U.S. Ser. No. 08/409,125 (D/94639) filed Mar. 23, 1995, the disclosures of which are incorporated by reference in their entirety herein, respectively, the target being mounted within the grinding chamber and centered on or near the central axis of the grinding chamber; and a plurality of sources of high velocity gas, the gas sources being mounted within the grinding chamber or on the peripheral wall, arrayed symmetrically about the central axis, and oriented to direct high velocity gas along an axis substantially perpendicularly intersecting the central axis, the central axis being situated within the impact target or intersection of gas streams. Each of the sources of high velocity gas comprises a nozzle having a hollow cylindrical body; an integral face plate member attached to the end of the cylindrical body directed towards the center of the jet mill chamber; and an articulated annular slotted aperture in the face plate for communicating a gas stream from the nozzle to the chamber and wherein the stream contains, or is capable of entraining, about substantially in, or on, the gas stream surface. In embodiments, the articulated annular slotted aperture can be concentrically situated about the long axis of the cylindrical body, that is, centered about the center of the face plate.

With reference to FIGS. 1–4, there are illustrated nozzle face plates having different geometrical configurations of the opening or aperture(s) therein. These configurations are compared with respect to their relative perimeters or circumferences of the openings in the face plates for comparable or normalized area of the opening, reference the accompanying Table 1. That is, a comparable or approximately common area value (A) was selected and the opening or orifice primary dimensions, such as diameter, or length and width as appropriate, and perimeter dimensions, were calculated therefrom using known geometrical equations and relationships, reference the footnotes 1–4, in Table 1. The perimeter analysis and comparison is illustrated for typical face plate sizes used in hypothetical "Pilot Scale" and "Production Scale" fluid bed jet mills. The primary dimensions determine the dimensions used in constructing a particular aperture configuration while the perimeter dimension(s) for a particular aperture configuration indicate the dynamic or continuously generated surface area that will be afforded to a gas stream passing through the aperture or apertures and therefore the surface area which is available to entrain particulate material for grinding. The aperture geometries, areas (A) and available entrainment perimeters (P), of the nozzle configurations shown in the Figures are contained in accompanying Table 1. As should be evident from the foregoing discourse, a gas stream passing through a nozzle opening(s) continuously sweeps along the aperture perimeter and thereby creates a particle entrainment surface area or areas.

With respect to Table 1, the following terms are recited and exemplary respective values are contained therein.

"Nozzle or Orifice diameter" refer to the diameter of the opening in the nozzle face plate through which the gas stream passes.

"Nozzle area" refers to the area of the opening in the nozzle face plate through which the gas stream passes.

"Nozzle perimeter" refers to the perimeter or circumference of the opening in the nozzle face plate through which the gas stream passes.

"Orifice area" refers to the total area of the openings in the nozzle face plate through which the gas stream passes.

"Orifice perimeter" refers to the total perimeter or total circumference of the openings in the nozzle face plate through which the gas stream passes.

"Slot length and width" refer to the length and width of a hypothetical rectangular slotted region or regions in the nozzle face plate.

"Slot area" refers to the total area of the slotted opening or openings in the nozzle face plate through which the gas stream passes.

"Slot perimeter" refers to the total perimeter or circumference of the slotted opening or openings in the nozzle face plate through which the gas stream passes.

Figure 4:
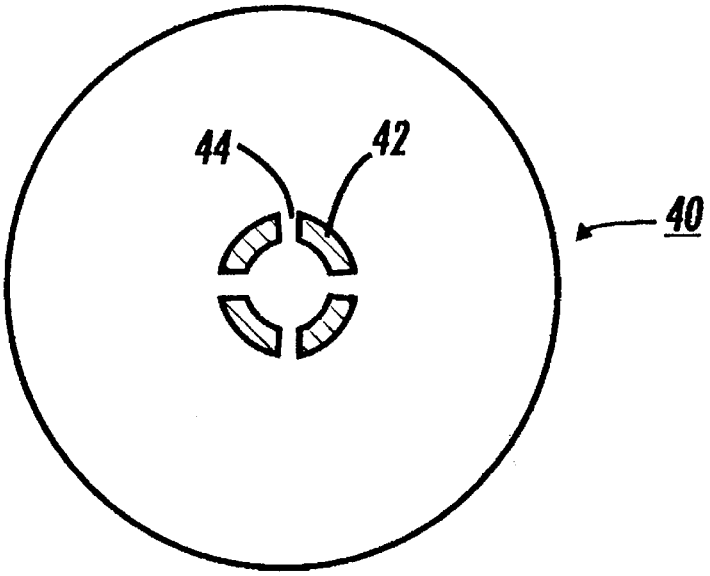
FIGS. 4 is a schematic representation of a circular nozzle face plate with an articulated annular slotted aperture or apertures in embodiments of the present invention.

"Articulated" refers to an interrupted or noncontinuous arcuate slot or annular aperture substantially as illustrated, for example, in FIG. 4.

There is illustrated in FIG. 1, a nozzle face plate configuration comprising a face plate 1 with circular aperture 2 therein and which configuration is known in the art. This configuration is disadvantaged in that a gas stream passing through the nozzle aperture or orifice 2 will have a limited surface area in which to entrain particulate material. The limiting surface area of the gas stream corresponds to the circumference or perimeter of the aperture 2.

Figure 2:
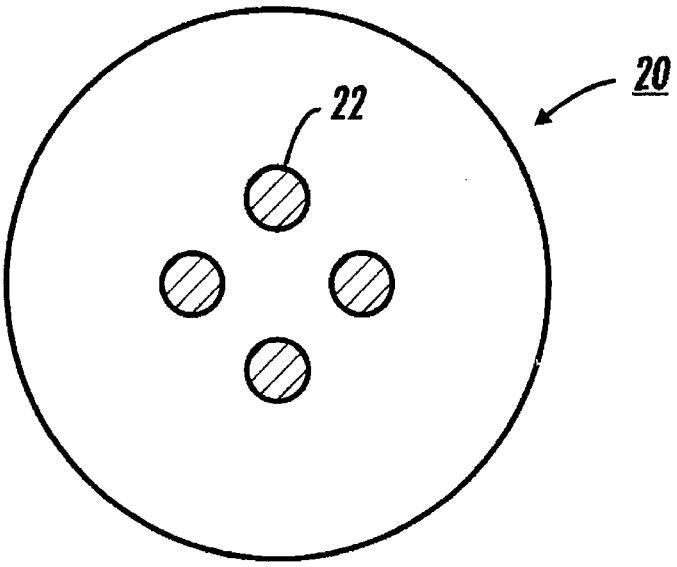
FIG. 2 (PRIOR ART)
FIG. 2 is a schematic representation of a circular nozzle face plate with four circular apertures therein as disclosed in the prior art.

In FIG. 2 there is illustrated another nozzle face plate configuration comprising face plate 20 with four circular apertures 22 therein. The nozzle of FIG. 2 provides increased gas stream—particle entrainment surface area by a factor of greater than 2 compared to the nozzle configuration of FIG. 1. A nozzle face plate substantially identical and as illustrated in FIG. 2 is commercially available as MEGAJET from Alpine Company.

Figure 3:
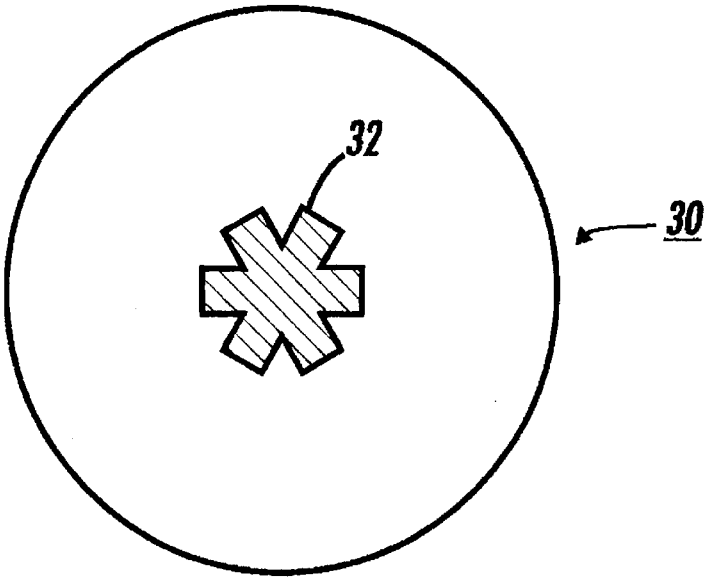
FIG. 3 (PRIOR ART)
FIGS. 3 is a schematic representation of a circular nozzle face plate with a single cross hatch shaped aperture comprised of multiply overlapping rectilinear slotted apertures.

In FIG. 3 there is illustrated yet another nozzle face plate configuration comprising face plate 30 with aperture 32 comprised of three crossed or intersecting and overlapping rectilinear slots.

In FIG. 4 there is illustrated a nozzle face plate configuration, as used in embodiments of the present invention, comprising face plate 40 with interrupted or articulated apertures 42 having a number of interruptions or articulations 44 therebetween. The nozzle area (A) of the articulated annular slotted face plate of FIG. 4 is determined by the formula $$A=\Pi D_o^2((s/D_o-(s/D_o)^2)(360-a)/360$$

and wherein the perimeter (P) of the slots is determined by the formula $$P=2\Pi(D_o-s)(360-a)/360+2ns$$

where $D_o$ is the outer diameter of the annulus, s is the slot width, a is the total angle or arc swept out by the non-slotted region within the annular region and excludes the articulated or interrupted area or areas, and n is an integer from 1 to about 10 and represents the number of articulations or interrupts in the annular region, and in the embodiment illustrated, n is equal to 4.

Also known in the art, but not shown in the figures, is a nozzle face plate configuration comprising an unarticulated annular slotted opening, that is, a continuous, uninterrupted annular or ring like opening in the nozzle face plate, for example, as available from CONDUX, AG. The unarticulated annular slotted opening is achieved by incorporating a central feed tube within nozzle body and traversing the nozzle barrel. The need for a central feed tube and assurance of its continued function during operation adds to the complexity, variability, and cost of installation and operation of grinders employing central feed tubes. It should be evident upon inspection, or upon calculation, that the aforementioned unarticulated annular slotted opening is disadvantaged relative to the articulated annular slotted opening configuration of the present invention, specifically since the available perimeter or surface area, that is, the surface area or perimeter of the annular opening, which is available for particle entrainment within the grinding chamber, although not wanting to be limited by theory, is believed to be limited to the outer circumference of the aperture since entrained particles are entrained and remain substantially at or on the surface of the gas stream and furthermore do not readily penetrate or traverse the body of the gas stream because of the extremely high velocity of the gas stream and the resultant forces exerted on the particulate materials. Thus, the perimeter or entrainment surface area available to the unarticulated annular slotted nozzle opening for particle entrainment within the grinding chamber is given by the same geometrical relation as for the circular nozzle opening configuration of FIG. 1 and is therefore considerably less than the entrainment surface area available to the articulated annular slotted nozzle of the present invention, particularly in situations where the aforementioned central feed tube is confounded with partial or complete particle blockage and cannot efficiently provide particles to the internal surface of the gas stream.

Typically, nozzles face plates are retrofitted in an existing mill to improve mill efficiency subject to the constraints noted below. It will be evident to one of ordinary skill in the art that the articulated nozzle aperture area, A, should be kept close to or be comparable to the aperture areas of the existing nozzles. This constraint is helpful for ensuring that the current compressed air supply capacity will be adequate and that total internal mill air flow and dynamics will be comparable to and remain within expected performance limits for normal system operation. The interrupted cross sectional area of the articulated annular slotted nozzle of the present invention should be sufficiently large to admit particles from the circulating mill load within the chamber to the interior of the aforementioned articulated gas stream for further grinding. This latter requirement is highly dependent on the particle feed size distribution and the product top size selected, that is the upper limit on particle size of acceptable product. Thus, in general, the size of the articulated arcuated slotted apertures in the nozzle face plate and the size, location, and number of the interrupts are selected such that both the perimeter or surface area of the gas stream flowing through the face plate apertures and the access of particles to the internal surface area are maximized subject to the above constraints. In general, a series of optimization experiments can be used to maximize these relations.

In embodiments of the present invention, the articulated annular slotted aperture has an open cross section area which is from about 0.01 to about 0.5 times the internal diameter cross section area of the nozzle barrel, and the face plate, for example, can be formed of a hardened ferrous alloy and the face plate and aperture surfaces are optionally coated with an abrasion resistant ceramic material.

The nozzle face plates of the present invention can be integral with the nozzle body or can be attached to the nozzle body by various known means such as a slip clamp or clasp, machined beveled edge slip fit, snap fit, pressure fit, ball bearing seat clamp, and the like, and which attachment situations enable the nozzles and nozzle face plates to be readily installed or removed from the jet mill for cleaning, servicing, or replacement. The fastening method and means chosen preferably provides an essentially stationary or fixed aperture and face plate relation to the nozzle during the continuous action of the gas stream.

In embodiments, the articulated aperture face plates of the present invention provide improved relative throughput mill efficiency of from about 5 to about 30 percent compared to either a circular or unarticulated annular aperture face plate of equivalent cross sectional area.

The gas stream passing through the nozzle face plate has a high velocity and creates an annular or articulated cylindrically shaped region in space wherein the particles to be ground are entrained in the surface of the gas stream and the entrained particles are substantially contained in an area substantially defined by the perimeter of the shaped region in cross section.

In embodiments of the present invention, the articulate arcuate slotted face plates are well suited for use in jet mill grinding of toner materials, for example, the unground particles are electrostatographic developer material particles with a mean volume diameter of about 5 to about 5,000 microns and the resulting smaller separated ground particles have a mean volume diameter of about 3 to about 30 microns.

In other embodiments of the present invention, fracturing of a portion of unground particles into smaller particles can be accomplished by projecting the high velocity particle gas stream created by the arcuate slotted nozzle against nearby or neighboring slow moving particles within the chamber of the fluid bed.

The articulated arcuate slotted nozzle face plates of the present invention enable a method for grinding particles of electrostatographic developer material comprising: introducing unground particles of electrostatographic developer material into a grinding chamber of a fluidized bed jet mill; injecting gas from a plurality of sources of high velocity gas attached to injecting nozzle comprising a hollow cylindrical body, an integral face plate member attached to the end of the cylindrical body directed towards the center of the jet mill, and an articulated annular slotted aperture in the face plate for communicating a gas stream from the nozzle to the grinding chamber to form a particulate gas stream in the jet mill; forming a fluidized bed of the unground particles; accelerating a portion of the unground particles with the high velocity gas stream to form a high velocity particle gas stream; fracturing a portion of the accelerated particles into smaller particles by projecting at least two particle streams in partial or complete opposition so that substantially all of the particles accelerated by the gas stream impact particles contained in an opposing stream; separating from the unground particles and the smaller particles a portion of the smaller particles smaller than a selected size; discharging the portion of the smaller particles from the grinding chamber; and continuing to grind the remainder of the smaller particles and the unground particles until the smaller particles smaller than a selected size are obtained thereby, for example, with a mean volume diameter of from about 3 to about 30 microns.

The nozzle opening cross sectional area can be any size such that the aforementioned relative dimensional relationships between the nozzle opening and the maximized gas stream surface area are achieved.

A principal function of the articulated annular slotted aperture is to provide a high perimeter and consequent surface area to the gas stream continuously passing therethrough. A second function of the articulated annular slotted aperture of the present invention is to provide a gas stream surface area that enables grinder bed particulate materials access to the interior surface area of the resultant articulated gas stream. The subsequent entrainment of particles into the internal surface area of the gas stream is accomplished without the need for the aforementioned central feed tube. The present invention thus provides in embodiments enhanced throughput efficiency and substantially simplifies the fluid bed jet mill complexity and cost of construction and operation.

In another embodiment, the aforementioned articulated slotted nozzle face plates of the present invention, may be used in conjunction with, for examples: one or more apertured impact targets of the type described in the aforementioned copending U.S. Ser. No. 08/409,125, wherein the aperture of the target preferrably matches the geometry and dimensions of the slotted apertured nozzle face plate of the present invention; and with accelerator tubes of the type described in the aforementioned copending U.S. Ser. No. 08/409,125 and the commonly owned U.S. Pat. No. 5,133,504, the disclosures of which are incorporated herein by reference in their entirety.

The thickness of the wall of the aforementioned nozzle face plate can be, in embodiments, from about 3 to about 30 millimeters, and which size may be determined from consideration of, for example, the contemplated gas velocity, particle size, particle type, desired particle size reduction levels, and throughput volumes and throughput efficiencies desired, the abrasiveness of the particulate material, desired service life, and the presence or absence of, for example, solid or hollow body targets or aperture plate type targets.

The articulate annular slotted apertured nozzle face plates of the present invention can be a flat plate, a convexly arcuate plate, or a concavely arcuate plate with respect to the direction of the gas stream.

In embodiments of the present invention, particle size reduction is accomplished by particle-stationary wall impingement and particle-particle stream impingement. Thus, improved material throughput efficiency and power consumption efficiencies are realized and are believed to be improved because of the aforementioned enhanced gas stream entrainment surface area afforded by the articulated arcuate slotted plates combined with the action of the particle-target impingement and/or particle-particle impingement processes. The relative throughput efficiency improvements are, in embodiments, from about 5 to 30 percent, and relative throughput efficiency increases for improvements from about 2 to in excess of about 50 percent are believed to be attainable. Exemplary throughput improvements of the present invention are demonstrated hereinafter.

As disclosed in U.S. Pat. No. 5,133,504 the high velocity particle gas stream creates, in embodiments, using a circular orifice, a conical shaped region with an apparent apex of the conical region emanating approximately from a point at, or within, the nozzle, and the base of the conical region is directed towards the impact target and the central axis of the conical region is perpendicular to the central axis, and wherein the particles contained in the particle gas stream are substantially contained in an annular area substantially defined by a perimeter of a circular conic section of the surface of the conical shaped region. Thus, the articulated nozzle face plates of the present invention, although not wanting to be limited by theory, are believed to provide a double or concentric conical region capable of entraining particles.

The particulate material suitable for grinding and particle size reduction in the present invention can be toner, developer, resin, resin blends and alloys, filled thermoplastic resin composite particles, and the like particles. In preferred embodiments, the particulate material is toner particles, pigment particles, resin particles, toner charge control additives, uncoated carrier particles, resin coated carrier particles, and mixtures thereof. Unground particles are preferrably electrostatographic developer material particles with a mean diameter of about 5 to about 5,000 microns. The smaller or ground particles removed from the grinding chamber and process have a mean diameter of about 3 to about 30 microns. The parameters required to achieve desired particle size properties can be determined empirically and is a preferred practice in view of the large number of process variables.

Ground particles are suitable for use as electrostatographic developer material selected from the group consisting of single component and two component toner particles comprising a binder resin, a pigment, and optional additives. A suitable binder resin for particle size reduction in the present invention can have, for example, a broadly distributed molecular weight centered about approximately 60,000.

Embodiments of the present invention include:

a fluidized bed jet mill for grinding particulate material including a jetting nozzle comprising: a hollow cylindrical body; an integral face plate member attached to the end of the cylindrical body directed towards the center of the jet mill; and an articulated annular slotted aperture in the face plate for communicating a gas stream from the nozzle to the grinding chamber to form a particulate gas stream in the jet mill;

the aforementioned fluidized bed jet mill wherein at least one jetting nozzle is present and wherein the relative throughput efficiency of the mill is improved by from about 5 to about 30 percent when the articulated annular slotted apertured face plate is used in place of a circular aperture face plate of equivalent cross sectional area;

a method of grinding particles comprising: a) introducing unground particles into a grinding chamber of a fluidized bed jet mill; b) injecting gas from a plurality of sources of high velocity gas into the grinding chamber through a nozzle comprising: a hollow cylindrical body; an integral face plate member attached to the end of the cylindrical body directed towards the center of the jet mill; and an articulated annular slotted aperture in the face plate for communicating a gas stream from the nozzle to the grinding chamber to form a particulate gas stream in the jet mill; c) forming a fluidized bed of said unground particles within the chamber; d) entraining and accelerating a portion of said unground particles with said high velocity gas to form a high velocity particle gas stream; e) fracturing said portion of said entrained particles into smaller particles by projecting the particle gas stream against opposing particle gas streams; f) separating from said unground particles and said smaller particles a portion of said smaller particles smaller than a selected size; g) discharging said portion of said smaller particles from said grinding chamber; and h) continuing to grind the remainder of said smaller particles and said unground particles until said smaller particles smaller than a selected size are obtained thereby, wherein said high velocity gas stream has a high surface area periphery or profile, and wherein the relative throughput grinding efficiency is improved from about 5 percent to about 30 percent compared to a circular aperture nozzle of equivalent cross sectional area; and a method for grinding particles of electrostatographic developer material comprising: a) introducing unground particles of electrostatographic developer material into a grinding chamber of a fluidized bed jet mill; b) injecting gas from a plurality of sources of high velocity gas attached to injecting nozzle comprising: a hollow cylindrical body; an integral face plate member attached to the end of the cylindrical body directed towards the center of the jet mill; and an articulated annular slotted aperture in the face plate for communicating a gas stream from the nozzle to the grinding chamber to form a particulate gas stream in the jet mill; c) forming a fluidized bed of said unground particles; d) accelerating a portion of said unground particles with said high velocity gas stream to form a high velocity particle gas stream; e) fracturing a portion of the accelerated particles into smaller particles by projecting at least two particle streams in partial or complete opposition so that substantially all of the particles accelerated by the gas stream impact particles contained in an opposing stream; f) separating from said unground particles and said smaller particles a portion of said smaller particles smaller than a selected size; g) discharging said portion of said smaller particles from said grinding chamber; and h) continuing to grind the remainder of said smaller particles and said unground particles until said smaller particles smaller than a selected size are obtained thereby.

The invention will further be illustrated in the following nonlimiting Examples, it being understood that these Examples are intended to be illustrative only and that the invention is not intended to be limited to the materials, conditions, process parameters, and the like, recited herein. Parts and percentages are by weight unless otherwise indicated.

EXAMPLES

Exemplary and non limiting tests can be conducted with the aforementioned articulated slotted apertures wherein the throughput efficiency of the fluidized bed jet mill, and specifically, enhanced throughput efficiencies in amounts of from 5 to about 30 relative percent compared to a circular or unarticulated annular aperture may be obtained. For example, a Condux CGS-50 mill, similar in design and operation to the disclosed embodiments, and nozzle geometries can be used in the testing. The aforementioned pilot scale mill has a grinding chamber with an internal diameter of approximately 24 inches and a height of approximately 60 inches. The mill is fitted with three equally spaced nozzles each with an internal diameter of about 7.5 mm. The compressed gas is dry air supplied by a compressor at a constant pressure of 115 psia at a nominal air flow of 450 cubic feet per minute (cfm). The compressed air is intercooled to a stagnation temperature of about 70 to 80 degrees Fahrenheit before it enters the compressed air manifold. The mill is fitted with a standard mechanical classifier for the Condux CGS-50 mill.

The mill is tested in the nozzle geometries illustrated in the Figures and as tabulated in Table 1. The nozzle internal diameter in each of the Examples was 7.5 mm. Each aperture face plate is positioned normal to the nominal flow of the compressed gas. Mill efficiency as used herein can be characterized by the expression $$E=T/\{Q \ln (P/P_o)\}$$

where E is efficiency, T is throughput in mass per unit time, for example, pounds per hour, Q is air flow rate, P is grind pressure, and $P_o$ is chamber pressure.

The feed material is a two component toner comprised, by weight, of approximately one fifth magnetite such as MAPICO Black™, one twentieth carbon black, such as REGAL 330® and three quarters binder resin of poly (styrene butadiene) having a broadly distributed molecular weight centered about 60,000. The toner was ground from an initial mean diameter of 7,500 microns to a final mean diameter of approximately 10 microns.

From a consideration of the aforementioned geometrical properties of the nozzle opening and the resultant surface area of the gas jet stream it is expected that the articulated annular slotted nozzle orifice, for example, where n=4, can provide from about a 5 to 30 percent relative increase in throughput efficiency over the baseline configuration, that is, as shown in FIG. 1.

The aforementioned patents and publications are incorporated by reference herein in their entirety.

Other modifications of the present invention may occur to those skilled in the art based upon a review of the present application and these modifications, including equivalents thereof, are intended to be included within the scope of the present invention.

TABLE 1

Comparison of Nozzle Geometries

| Nozzle Geometry | Pilot Scale | Production Scale |
|---|---|---|
| FIG. 1 | | |
| Nozzle Diameter (D) | 7.5 mm throat Dia. | 16 mm, throat dia. |
| Nozzle Area (A)[1] | 44.18 sq mm | 201.06 sq mm |
| Nozzle Perimeter (P)[1] | 23.56 mm | 50.27 mm |
| FIG. 2 | | |
| Orifice Diameter (d) | 3.75 mm | 8 mm |
| Number of Orifices (n) | 4 | 4 |
| Orifice Area (A)[2] | 44.18 sq mm | 201.06 sq mm |
| Orifice Perimeter (P)[2] | 47.12 mm | 100.53 mm |
| FIG. 3 | | |
| Slot Length (L) | 8.7 mm | 19.4 mm |
| Slot Width (s) | 2 mm | 4 mm |
| Number of Slots (n) | 3 | 3 |
| Slot Area (A)[3] | 44.20 sq mm | 200.8 sq mm |
| Slot Perimeter (P)[3] | 48.2 mm | 108.4 mm |
| FIG. 4 | | |
| Outer Diameter ($D_o$) | 10.4 mm | 23.2 mm |
| Slot Width (s) | 2 mm | 4 mm |
| Total Angle (a) | 60 degrees | 60 degrees |
| Interruptions (n) | 4 | 4 |
| Slot Area (A)[4] | 43.98 sq mm | 201.06 sq mm |
| Slot Perimeter (P)[4] | 59.98 mm | 132.53 mm |

1.) $A=(\Pi D^2)/4$ or $(\Pi/4)D^2$; $P=\Pi D$
2.) $A=(\Pi nd^2)/4$ or $(\Pi/4)nd^2$; $P=\Pi nd$
3.) $A=nLs-(n-1)s^2$; $P=2n(L+s)-4(n-1)s$
4.) $A=\Pi D_o^2(s/D_o-(s/D_o)^2)(360-a)/360$; $P=2\Pi(D_o-s)(360-a)/360 + 2ns$

What is claimed is:

1. A fluidized bed jet mill for grinding particulate material including a jetting nozzle comprising:

a grinding chamber;

at least one hollow cylindrical body traversing the wall of the grinding chamber;

an integral face plate member attached to the end of the cylindrical body directed towards the center of the jet mill grinding chamber; and an articulated annular slotted aperture in the face plate for communicating a gas stream from the hollow body to the grinding chamber to form a particulate gas stream in the jet mill.

2. A jet mill in accordance with claim 1 wherein the gas stream upon entering the chamber entrains particles which are present in the chamber.

3. A jet mill in accordance with claim 1 wherein the gas stream contains particles prior to entering the chamber.

4. A jet mill in accordance with claim 1 wherein the articulated annular slotted aperture is concentrically situated about the long axis of the cylindrical body.

5. A jet mill in accordance with claim 1 wherein the particulate gas stream has a high surface area periphery.

6. A jet mill in accordance with claim 1 wherein the particles in the particulate gas stream are substantially concentrated in or at the high surface area periphery of the stream.

7. A jet mill in accordance with claim 1 wherein the area (A) of the articulated annular slots is determined by the formula $$A=\Pi D_o^2((s/D_o-(s/D_o)^2)(360-a)/360$$

and wherein the perimeter (P) slots is determined by the formula $$P=2\Pi(D_o-s)(360-a)/360+2ns$$

where $D_o$ is the outer diameter of the annulus, s is the slot width, a is the total angle or arc of the articulated areas which are not swept out by the annulus, and n is an integer from 1 to about 10 and represents the number of articulations in the annular region.

8. A jet mill in accordance with claim 1 wherein the aperture comprises a cross section area of from about 0.01 to about 0.5 times the internal cross section area of the hollow body.

9. A jet mill in accordance with claim 1 wherein the face plate comprises a hardened ferrous alloy and wherein the face plate and aperture are optionally coated with an abrasion resistant ceramic material.

10. A jet mill in accordance with claim 1 wherein at least one jetting nozzle is present and wherein the relative throughput efficiency of the mill is improved by from about 5 to about 30 percent when the articulated annular slotted apertured face plate is used in place of a circular aperture face plate of equivalent cross sectional area.

11. A jet mill in accordance with claim 1 wherein the gas stream passing through the nozzle face plate has a high velocity and creates an articulated annular or cylindrically shaped region in space and wherein the particles in the particle gas stream are substantially contained in an area substantially defined by the perimeter of the shaped region in cross section.

12. A jet mill in accordance with claim 1 wherein the particulate material for grinding is selected from the group consisting of toner particles, pigment particles, resin particles, toner surface additive particles, toner charge control additives, uncoated carrier particles, resin coated carrier particles, and mixtures thereof.

13. A method of grinding particles comprising:

a) introducing unground particles into a grinding chamber of a fluidized bed jet mill;

b) injecting gas from a plurality of sources of high velocity gas into the grinding chamber through a nozzle comprising: a hollow cylindrical body; an integral face plate member attached to the end of the cylindrical body directed towards the center of the jet mill; and an articulated annular slotted aperture in the face plate for communicating a gas stream from the nozzle to the grinding chamber to form a particulate gas stream in the jet mill;

c) forming a fluidized bed of said unground particles within the chamber;

d) entraining and accelerating a portion of said unground particles with said high velocity gas to form a high velocity particle gas stream;

e) fracturing said portion of said entrained particles into smaller particles by projecting the particle gas stream against opposing particle gas streams;

f) separating from said unground particles and said smaller particles a portion of said smaller particles smaller than a selected size;

g) discharging said portion of said smaller particles from said grinding chamber; and h) continuing to grind the remainder of said smaller particles and said unground particles until said smaller particles smaller than a selected size are obtained thereby, wherein said high velocity gas stream has a high surface area periphery or profile, and wherein the relative throughput grinding efficiency is improved from about 5 percent to about 30 percent compared to a circular aperture nozzle of equivalent cross sectional area.

14. The method of claim 13 wherein said unground particles are electrostatographic developer material particles with a mean volume diameter of about 5 to about 5,000 microns and the smaller ground particles have a mean volume diameter of about 3 to about 30 microns.

15. The method of claim 13 further comprising fracturing a portion of unground particles into smaller particles by projecting the high velocity particle gas stream created by the nozzle against nearby or neighboring slow moving particles within the chamber of the fluid bed.

16. A method for grinding particles of electrostatographic developer material comprising:

a) introducing unground particles of electrostatographic developer material into a grinding chamber of a fluidized bed jet mill;

b) injecting gas from a plurality of sources of high velocity gas attached to injecting nozzle comprising: a hollow cylindrical body; an integral face plate member attached to the end of the cylindrical body directed towards the center of the jet mill; and an articulated annular slotted aperture in the face prate for communicating a gas stream from the nozzle to the grinding chamber to form a particulate gas stream in the jet mill;

c) forming a fluidized bed of said unground particles;

d) accelerating a portion of said unground particles with said high velocity gas stream to form a high velocity particle gas stream;

e) fracturing a portion of the accelerated particles into smaller particles by projecting at least two particle streams in partial or complete opposition so that substantially all of the particles accelerated by the gas stream impact particles contained in an opposing stream;

f) separating from said unground particles and said smaller particles a portion of said smaller particles smaller than a selected size;

g) discharging said portion of said smaller particles from said grinding chamber; and h) continuing to grind the remainder of said smaller particles and said unground particles until said smaller particles smaller than a selected size are obtained thereby.

17. The method of claim 16 wherein the size of said smaller particles smaller than a selected size have a mean volume diameter of from about 3 to about 30 microns.

* * * * *